US008893735B2

(12) United States Patent
Shatz

(10) Patent No.: US 8,893,735 B2
(45) Date of Patent: Nov. 25, 2014

(54) DEVICE AND METHOD FOR CLEANING JEWELRY

(76) Inventor: Adam Shatz, Greenwich, CT (US)

( * ) Notice: Subject to any disclaimer, the term of this patent is extended or adjusted under 35 U.S.C. 154(b) by 68 days.

(21) Appl. No.: 13/364,936

(22) Filed: Feb. 2, 2012

(65) Prior Publication Data

US 2012/0192895 A1 Aug. 2, 2012

Related U.S. Application Data

(60) Provisional application No. 61/438,708, filed on Feb. 2, 2011.

(51) Int. Cl.

| | |
|---|---|
| ***A46B 7/06*** | (2006.01) |
| ***A46B 9/02*** | (2006.01) |
| *A46B 1/00* | (2006.01) |

(52) U.S. Cl.

CPC . *A46B 9/026* (2013.01); *A46B 1/00* (2013.01); *A61B 9/028* (2013.01); *A46B 2200/3013* (2013.01)

USPC ..... 134/184; 134/104.2; 15/88.4; 15/159.1; 15/160

(58) Field of Classification Search

None

See application file for complete search history.

(56) References Cited

U.S. PATENT DOCUMENTS

| | | | |
|---|---|---|---|
| 1,683,458 | A | 9/1928 | Hall |
| 2,362,251 | A | 11/1944 | Eggleton |
| 2,807,037 | A | 9/1957 | Garske |
| 3,135,987 | A | 6/1964 | Hugh |
| 4,442,564 | A | 4/1984 | Berry |
| 4,899,413 | A | 2/1990 | Trobiani |
| 5,298,077 | A | 3/1994 | Saarela et al. |
| 6,813,798 | B2 | 11/2004 | Moga |

*Primary Examiner* — Michael Kornakov
*Assistant Examiner* — Ryan Coleman
(74) *Attorney, Agent, or Firm* — Charles A. Rattner

(57) ABSTRACT

A jewelry cleaning device may include the following components: a basin having a base portion and for holding a cleaning solution, a support post extending upwards from the base portion inside the basin and shaped to securely hold a piece of jewelry in place, and a sleeve sized to fit within the basin and having a plurality of bristles disposed therein with a handle portion on the top end thereof. A plastic dome may likewise be provided on a top end of the sleeve. All components may be modular and may be readily fitted together to form a unitary jewelry cleaning device. By rotating the sleeve using the handle portion while a piece of jewelry is supported within the cleaning solution of the basin on the support post, a user may cause the bristles to clean a piece of jewelry.

10 Claims, 3 Drawing Sheets

DEVICE AND METHOD FOR CLEANING JEWELRY

CROSS-REFERENCE TO RELATED APPLICATIONS

This application claims priority under 35 U.S.C. §119(e) to U.S. Provisional Patent Application Ser. No. 61/438,708 entitled DEVICE AND METHOD FOR CLEANING JEWELRY filed in the name of Adam Shatz on Feb. 2, 2011, the entirety of which is hereby incorporated by reference.

TECHNICAL FIELD

The present disclosure relates to devices and methods that are used to clean jewelry, and more particularly, it relates to devices and methods that utilize moving brushes or bristles to clean jewelry.

BACKGROUND OF THE DISCLOSURE

Jewelry is valued for its appearance and beauty. In order to maintain that appearance, it is necessary from time to time to clean the piece of jewelry. Oftentimes, a person will clean jewelry by applying a cleaning solution thereto and vigorously rubbing the jewelry with a cloth or the like. Alternatively, a person may clean the jewelry over a sink and using a faucet thereof. Both these processes are tedious, messy and can inadvertently result in the loss of portions of the jewelry when the wiping or washing dislodges such portions from the jewelry. This can be particularly troubling as the pieces can be lost on a floor or down the drain of a faucet, accordingly, thereby impeding any repair of the piece of jewelry.

Accordingly, there is a need for a method and apparatus for a device and method for cleaning jewelry that addresses certain problems of existing methods and technologies.

SUMMARY OF THE DISCLOSURE

It is an object of the present disclosure, therefore, to introduce a device and method for cleaning jewelry. In particular, one aspect of the disclosure includes a device for cleaning jewelry includes a basin for holding a cleaning solution therein. The basin includes a base portion forming a bottom end thereof. A support post extending upwardly from the bottom end of the base portion inside the basin and is shaped or tapered to hold a piece of jewelry in place securely. A sleeve is insertable within the basin. The sleeve has a plurality of bristles disposed therein for contacting and cleaning the piece of jewelry.

In another aspect of the present disclosure, a method is provided for cleaning a piece of jewelry using a cleaning device. The method comprises (i) pouring a cleaning solution into a basin having a support post disposed therein, (ii) securing a piece of jewelry within the basin using the support post, (iii) inserting a sleeve into the basin, the sleeve having a plurality of cleaning bristles for contacting the piece of jewelry and a handle portion for use by a hand of a user; and (iv) rotating the handle of the sleeve about the support post, thereby cleaning the piece of jewelry.

In additional embodiments of the present disclosure, the jewelry cleaning device may include a dome that is attachable/detachable or securely disposed on or integrated with the sleeve. The dome serves to enclose a top portion of the sleeve to prevent cleaning fluid from leaking through a top end of the sleeve. The dome may have a partially or total transparency to allow viewing of the piece of jewelry while it is being cleaned.

Alternatively, the dome may be partially or totally opaque and/or may include a transparent or sem-transparent window for viewing the jewelry while it is being cleaned.

In various embodiment, the jewelry cleaning device may be sized to fit within the hands of a user for ease of use.

BRIEF DESCRIPTION OF THE DRAWINGS

Further aspects of the present disclosure will be more readily appreciated upon review of the detailed description of its various embodiments, described below, when taken in conjunction with the accompanying drawings, of which.

DETAILED DESCRIPTION OF THE DISCLOSURE

Figure 1:
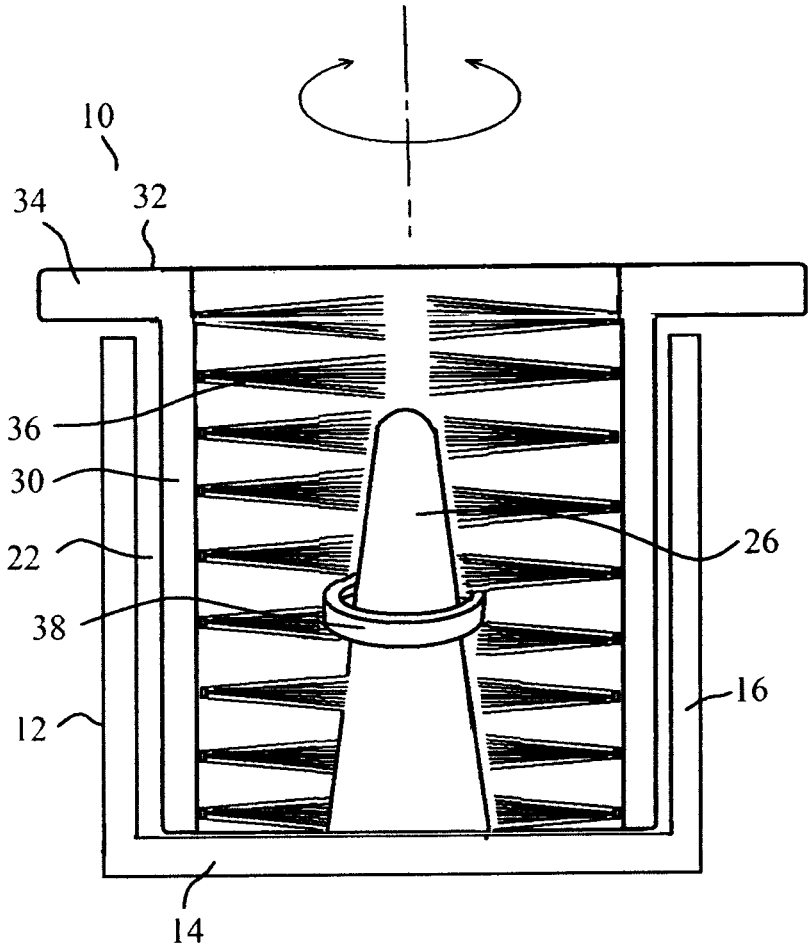
FIG. 1 is a cross-sectional view of an exemplary embodiment of a jewelry cleaner according to the present disclosure.
Figure 2:
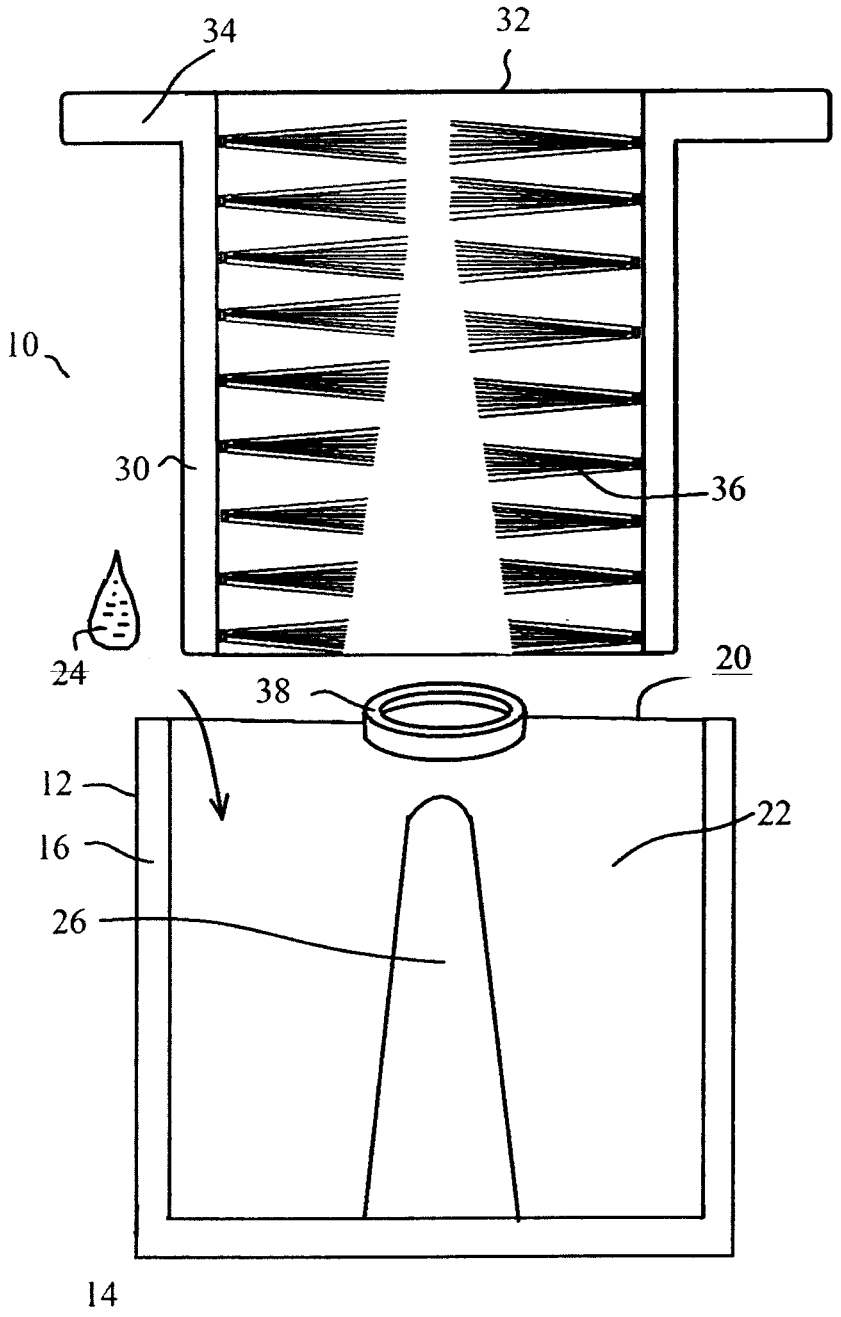
FIG. 2 is an exploded view of the various components of the jewelry cleaner of FIG. 1.
Figure 3:
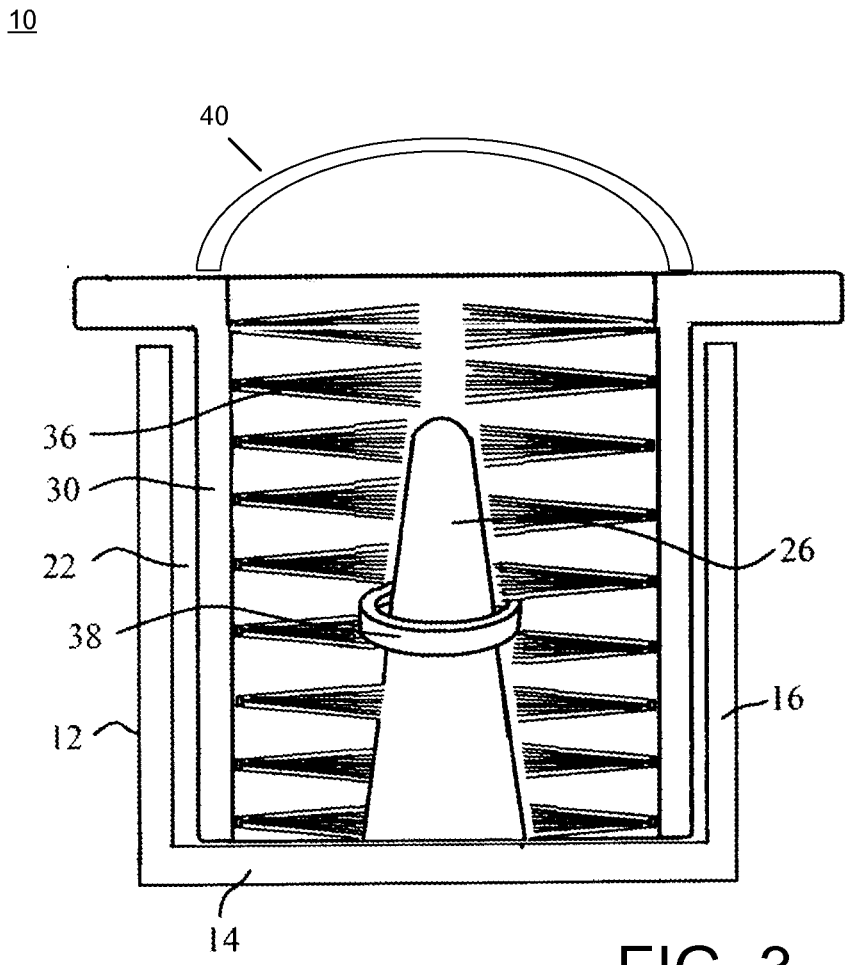
FIG. 3 depicts an additional embodiment of the jewelry cleaner of FIG. 1.

Referring now to FIGS. 1-3, wherein similar components of the present disclosure are referenced in like manner, various embodiments of a device and method for cleaning jewelry are disclosed. Although such a jewelry cleaning device 10 can be embodied in many ways, the embodiments illustrated are described with respect to cleaning a ring. This embodiment is selected in order to set forth one of the best modes contemplated for using the disclosed jewelry cleaning device 10. The illustrated embodiments, however, are merely exemplary and should not be considered a limitation when interpreting the scope of the claims.

Turning now to FIG. 1 in conjunction with FIG. 2, exemplary embodiments of a jewelry cleaning device 10 are shown therein. A jewelry cleaning device 10 includes a free-standing basin 12. The basin 12 rests upon a base 14 and has a peripheral wall 16 that extends to an open top 20. The basin 12 defines a cleaning chamber 22 that is capable of receiving and holding a predetermined volume of a cleaning fluid 24 therein, such as a cleaning solution. The basin prevents any components of the piece of jewelry from being lost while the jewelry 38 is being cleaned. In certain embodiments, the basin 12 is substantially cylindrical or circular.

A jewelry support post 26 is provided in the center of the cleaning chamber 22. The support post 26 is anchored to the base 14 at a bottom end of the base 14 of the basin 12 and extends upwardly in the center of the cleaning chamber 22. The support post 26 illustrated may be tapered so that it can receive and retain a variety of rings, bracelets, hooped earrings and other annular shaped pieces of jewelry. The support post 26, however, may instead be provided in a variety of differing shapes in order to accommodate other specialized pieces of jewelry 38. In certain embodiments, the support post 26 is integrally molded with the basin 12. In certain embodiments, the support post 26 is detachable from and attachable to the basin 12. As stated above, the support post 26 may be tapered so that it may be inserted through any annular portion of the piece of jewelry 38. In various embodiments, the support post 26 extends substantially from a center of the bottom end or base 14 of the basin 12.

A sleeve 30 is provided that is sized to pass into the cleaning chamber 22 around the support post 26. The sleeve 30 is taller than the cleaning chamber 22 and has a top end 32 that extends above the cleaning chamber 22. A handle flange 34 may be formed onto the top end 32 of the sleeve 30 to help a person manually grasp and turn the sleeve 30. In certain embodiments, the sleeve 30 may be substantially circular and bristles 36 are disposed within the sleeve 30 so as to contact the piece of jewelry 38 from a variety of different positions. In certain embodiments, the bristles are distributed along an inner periphery of the sleeve 30 in a circular manner so that many sides of the piece of jewelry 38 may be cleaned at once.

Brush bristles 36 are attached to the interior of the sleeve 30. The brush bristles 36 extend inwardly. The brush bristles 36 are positioned and shaped to accommodate the shape of the support post 26. It will therefore be understood that when the sleeve 30 is placed into the basin 12, the brush bristles 36 lightly touch the piece of jewelry 38 and/or the support post 26.

To utilize the device 10, a user separates the sleeve 30 from the basin 12. A piece of jewelry 38 is then placed on the support post 26. The sleeve 30 is again placed or inserted into the basin 12, wherein the sleeve 30 and the brush bristles 36 surround the jewelry 38. The sleeve 30 is then manually rotated about a vertical axis in relative motion to the basin 12. This causes the brush bristles 36 to rotate over the jewelry 38 and clean the jewelry 38.

Referring now to FIG. 3, therein are depicted additional embodiments of a jewelry cleaning device 10 in which common components of the device 10 are similarly numbered as in FIGS. 1 and 2. In these embodiments, the jewelry cleaning device 10 further includes a dome 40 disposed over the sleeve 30 at the top end 32 thereof. The dome may comprise a plastic material having a transparency that allows viewing of the piece of jewelry being cleaned within the device. As stated previously, the dome may enclose a top end 32 of the sleeve 30 to prevent cleaning fluid 24 from leaking through the top end 32 of the sleeve 30. The dome 40 may be partially or totally transparent to allow viewing of the piece of jewelry 38 while it is being cleaned. Alternatively, the dome 40 may be partially or totally opaque and/or may include a transparent or semi-transparent window for viewing the jewelry 38 while it is being cleaned.

It is readily contemplated that the jewelry cleaning device 10 and its various components may be made from a variety of useful durable materials including any useful metals and/or plastics. The basin 12 and sleeve 30 may be transparent, semi-transparent or opaque. In certain embodiments, the basin 12 and the sleeve 30 are modular, separable plastic, molded components. In other embodiments, the basin 12 and sleeve 30 are integrally formed, and the sleeve 30 may be partially or totally detachable from the basin 12.

Although the best methodologies have been particularly described in the foregoing disclosure, it is to be understood that such descriptions have been provided for purposes of illustration only, and that other variations both in form and in detail can be made thereupon by those skilled in the art without departing from the spirit and scope of the present disclosure, which are defined first and foremost by the appended claims.

What is claimed is:

1. A device for cleaning jewelry, comprising:

a basin for holding a cleaning solution therein, the basin including a base portion forming a bottom end thereof;

a tapered support post extending upwardly from the bottom end of the base portion and from a geometric center of the bottom end of the basin, the tapered support post shaped to hold a piece of jewelry in place, and a sleeve for insertion within the basin, the sleeve having a plurality of bristles extending horizontally with respect to the bottom end from an inner vertical sidewall of the sleeve, the bristles for contacting the piece of jewelry when placed on the tapered support.

2. The device of claim 1, further comprising a dome disposed over the sleeve at a top end thereof.

3. The device of claim 2, wherein the dome comprises a plastic material having a transparency that allows viewing of the piece of jewelry being cleaned within the device.

4. The device of claim 1, wherein the basin and the sleeve are modular, separable plastic, molded components.

5. The device of claim 1, wherein the support post is integrally molded with the basin.

6. The device of claim 1, wherein the support post is detachable from the basin.

7. The device of claim 1, wherein the support post may be inserted through an annular portion of the piece of jewelry.

8. The device of claim 1, wherein the sleeve further includes a handle portion on a top end thereof.

9. The device of claim 1, wherein the sleeve is substantially circular and the bristles are disposed within the sleeve so as to contact the piece of jewelry from a variety of different positions.

10. The device of claim 1, wherein the bristles are distributed along the inner vertical sidewall of the sleeve in a circular manner, and the bristles are positioned and shaped to accommodate the support post such that when the sleeve is placed into the basin, at least some of the bristles touch the piece of jewelry held by the support post.

* * * * *